US005899781A

United States Patent [19]

McLaughlin

[11] Patent Number: 5,899,781

[45] Date of Patent: May 4, 1999

[54] SWIM FIN INCORPORATING PRONATION COMPENSATION STRUCTURE

[76] Inventor: Matthew M. McLaughlin, 1844 S. Pacific St., Oceanside, Calif. 92054

[21] Appl. No.: 08/966,372

[22] Filed: Nov. 7, 1997

[51] Int. Cl.[6] ..... A63C 31/11

[52] U.S. Cl. ..... 441/64

[58] Field of Search ..... 441/61, 64

[56] References Cited

U.S. PATENT DOCUMENTS

| | | | |
|---|---|---|---|
| 2,729,832 | 1/1956 | Schmitz | 441/64 |
| 3,810,269 | 5/1974 | Tabata et al. | 441/64 |
| 4,923,419 | 5/1990 | McCarthy | 441/64 |
| 5,266,062 | 11/1993 | Runckel | 441/64 |
| 5,356,323 | 10/1994 | Evans | 441/64 |

*Primary Examiner*—Sherman Basinger
*Attorney, Agent, or Firm*—John J. Murphey

[57] ABSTRACT

A pair of swim fins, each fin comprising a blade having a first planar surface and defined by an elongated front edge terminated by inner and outer corners and a rear portion, the front edge and rear portion held in spaced-apart arrangement by a pair of opposed side edges extending therebetween; the rear portion of the blade having formed therein the bottom portion of a foot pocket arranged about a second planar surface for partial insertion therein of the foot of the wearer and including an open heel portion and heel strap to retain foot in the pocket; wherein the bottom portion of the foot pocket is specifically outlined for each foot, including one slightly longer side thereof bordering the inside of the foot and another slightly shorter side, spaced-apart therefrom, bordering the outside of the foot; and, wherein the second planar surface of the pocket is inclined to the outside of the first planar surface of the blade to compensate for the natural pronation of the foot in the fin when the fins are used in undulating movement so as to improve the efficiency of the fins during use.

22 Claims, 5 Drawing Sheets

SWIM FIN INCORPORATING PRONATION COMPENSATION STRUCTURE

BACKGROUND OF THE INVENTION

1. Field of the Invention

This invention relates to the field of underwater swimming apparatus. More particularly, it relates to swim fins worn on the feet of underwater swimmers and to a unique construction that compensates for the natural pronation of the foot when using fins.

2. Description of the Prior Art

For man to efficiently swim underwater, he has had to develop certain products to make him more fish-like in his movements. Prime among these products are swim fins that are snugly attached to the swimmer's feet and each contain a large blade moveable by one's legs in an undulating motion. To achieve the highest efficiency in using these fins, the blades of the fins are maintained in a plane perpendicular to the direction of the swimmer's forward movement. This is not always possible due to the nature of one's skeletal makeup.

A person's natural anatomical structure of the ankle and foot results in what is known as "supination" or pigeon-toeing. When the swimmer uses the swim fins in a flutter kick, which is the anatomical flexion and extension of the hips, knees and ankles, the supination causes the fins to turn inward resulting in the plane of the fin blade to be turned away from perpendicularity to the direction of the swimmer's path and loss of efficiency of the fins and the swimmer. This matter is further explained in U.S. Pat No. 4,923,419 issued to Kevin I. McCarthy in 1990. His remedy for this supination was to build a swim fin with the foot pocket offset from the center of the fin.

Further study has shown that supination does not occur in a vacuum. It is often coupled with "pronation" which is the opposite of supination and defined as "the eversion and abduction of the foot causing a lowering of the medial edge thereof", see Stedman's Medical Dictionary, 23rd Edition, Williams & Wilkins, 1979, at page 1147. Pronation shows itself as a slight but noticeable rotation of the foot to the outside when wearing footwear. While it occurs with shoes of all type, namely the tendency to walk on the outside of the shoe, it is most noticeable in wearing swim fins where the foot turns or rotates to the "outside" causing the swim fin to rotate to the outside and out of perpendicularity with the path of travel of the swimmer.

Pronation reduces swim efficiency just as supination does even though they are opposite in feature. In the same Medical Dictionary, "supination" is defined as "the opposite of pronation". Accordingly, what is useful in solving supination problems will not be useful in solving pronation problems.

Further, a review of the prior art of swim fins shows some other problems not to have been solved and that still remain today as impediments to the growth of use of these under water apparatuses. For instance, the foot pocket of swim fins do not take into account the potential for loss or gross reduction of blood flow in the frontal area of the foot (the toes) during prolonged use of the fins. Foot pockets are notoriously tight, evidently to aid in holding the fins in a snug fit to the foot. Such tightness causes pain in the area of the toes and can produce problems that last far longer than the wearing of the fins.

In addition, the fin blade has traditionally been a long, wide fin blade squared off at the front edge without any consideration given to the use of the fin by the swimmer prior to entering the water. The fins interfere with free walking to the point that many call for walking backward in an effort to avoid tripping over the extended fin.

Further, most fins are made from tough materials such as hard rubber, hard plastic and hard plastic-rubber blends with smooth exterior finishes in an effort to provide strength in the water when the fins undergo the flutter kick. However, that same smooth, tough construction makes the fins extremely tough to walk with on dry land. And, walking on dry land with fins on is part and parcel of everyday use of swim fins. In most respects, it is the front edge of the blade that catches on the ground and trips up the swimmer. If it doesn't catch on something, the smooth surface on the bottom of the fin allows the fin to slide on dry land and cause the swimmer to fall down.

Still further, for the most part, swim fins are not used as rudders to guide the swimmer through the water or on the surface thereof. However, there appears no reason that they could not be used as such if constructed in the appropriate manner.

SUMMARY OF THE INVENTION

This invention is a unique swim fin and method of making it that relieves all the problems of the prior art as set forth above. The plane of the foot pocket is rotated slightly to the outside of the plane of the fin blade to compensate for pronation of the foot of the swimmer. This way, the swimmer can use his natural kick and yet keep the plane of the fin blade perpendicular to the path he or she wishes to travel. This pronation compensation lies between 5° and 15° from the plane of the fin blade.

The problem with squeezing the toes of the wearer's foot to insure that the fit of the fin is snug is alleviated in large part by completing the top of the foot pocket with two bands of cloth—a first, non-stretchable band that overrides the toes, and a second, stretchable band that overrides the top of the foot to the rear of the toes. A snug fit is maintained by the stretchable band fitting tightly over the foot while the toes are given more room to move and relax under the non-stretchable band.

The continual problem with tripping over the fin when walking forward on dry land is alleviated by rounding the inner corner of the front of the fin blade so that lifting the blade during walking does not allow the blade to contact the ground.

To solve the problem of slipping on dry land because of the smooth, tough surface on the fin is solved by attaching a high friction tread to the bottom of the fin that provides improved walking without interfering with the operation of the fin during the flutter kick.

Finally, while prior art swim fins are not used as rudders for the swimmer per se, this inventive set of swim fins incorporates elevated side walls along the edges of both sides of the fin blade that not only stiffen the blade, so that it delivers more energy to the water per stroke of the swimmer's foot, but acts as a rudder when the fin is brought into a still condition so that the swimmer can control the direction of his or her travel by movement of the foot as opposed to using their arms and hands which may be involved in other matters.

Accordingly, the main object of this invention is a pair of swim fins that remove the deleterious effects of pronation from the use of the fins in underwater travel. Other objects of the invention include a unique swim fin construction that provides for a snug fit between the foot and the fin yet allows a flow of blood to the toes of the foot that is sufficient to operate the fins in comfort; a fin construction that permits the fins to be worn and the swimmer to walk forward wearing them on dry land by rounding of f the inside corner of the blade to allow the swimmer to lift his fin clear of the ground during the forward step; a fin construction that incorporates a high friction tread on the exterior undersurface of the fin to prevent the swimmer from slipping and falling when walking on dry ground or on a wet surface wearing the fins; and, a construction of a swim fin that permits a high degree of rudder control to the swimmer when he or she brings the fins up to the middle position of a flutter kick and holds them steady.

A further object of the invention is to provide means for the use of swim fins which may be confined solely to the benefit of those using them and for the general convenience of the public, and to generally simplify and improve the construction and increase the practical efficiency and range of usefulness and convenience of swim fins designed for the stated purpose.

These and other objects of the invention may become apparent from a close reading of the preferred embodiments along with the drawings appended hereto. The protection sought by the inventor in this patent may be gleaned from a fair reading of the claims that conclude this specification.

DESCRIPTION OF THE PREFERRED EMBODIMENTS

Figure 1:
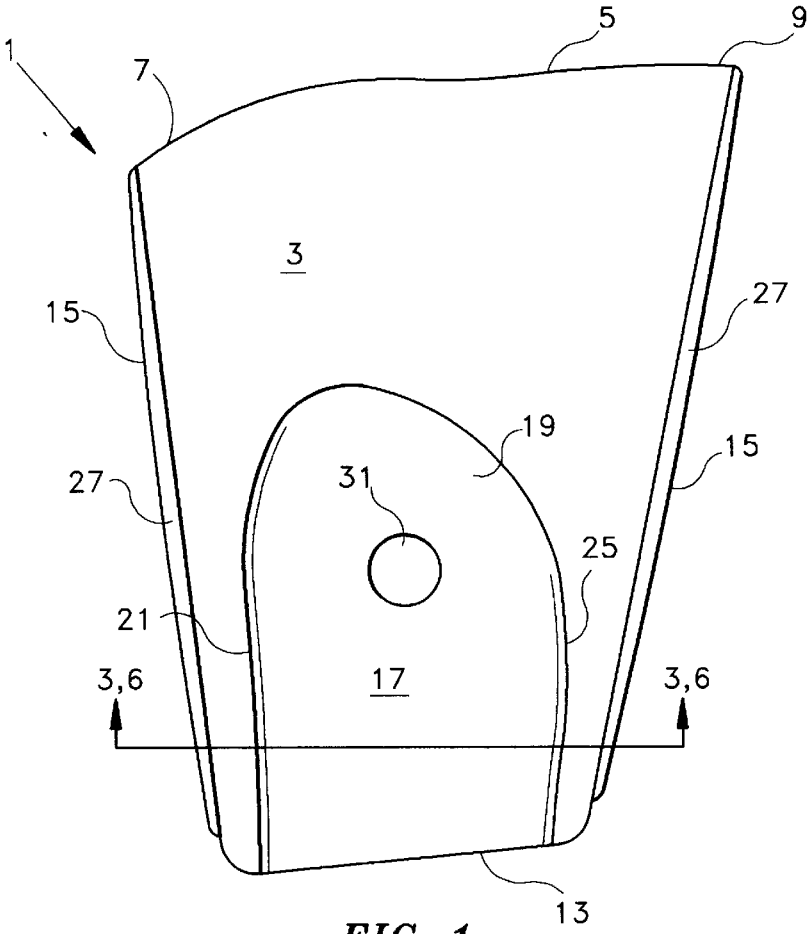
FIG. 1 is a top plan view of the blade and bottom portion of the foot pocket of this invention.
Figure 3:
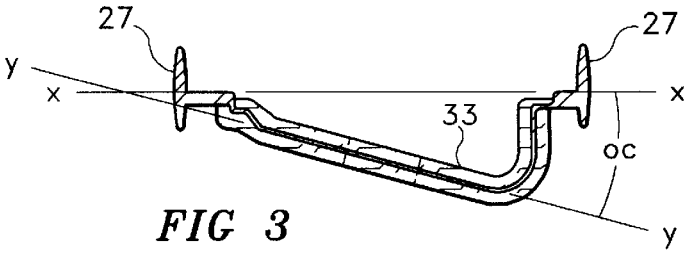
FIG. 3 is an end view of the preferred embodiment of this invention taken along lines 3—3 in FIG. 1.
Figure 7:
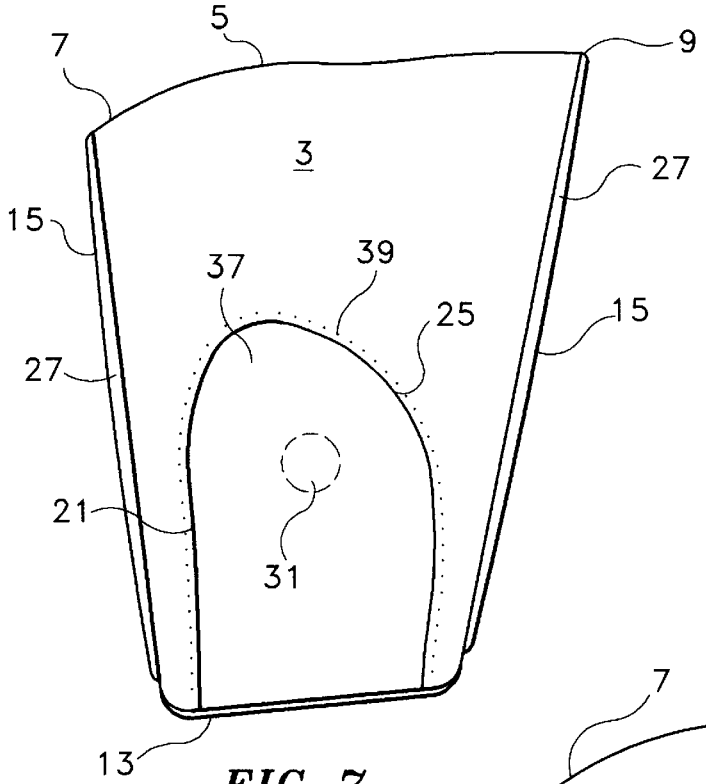
FIG. 7 is a top plan view of the preferred embodiment of this invention showing a single band of fabric closing over the top of the foot pocket.
Figure 2:
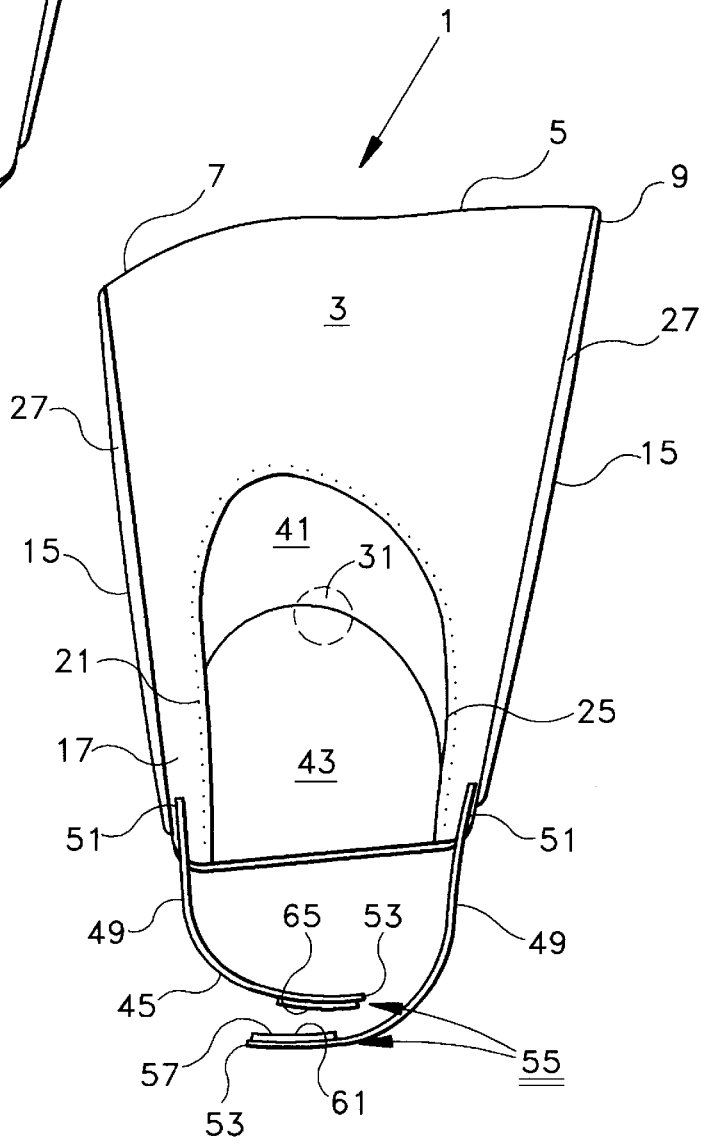
FIG. 2 is another top plan view of the blade and the whole foot pocket of this invention including the heel strap.

Turning now to the drawings where elements are marked with numerals and like elements in various drawings are identified with like numbers throughout the eleven figures, FIGS. 1, 2 and 3 show the basic embodiment of the invention 1 to comprise a blade 3, made of strong yet flexible material, having a first planar surface x—x and defined by an elongated front edge 5 terminated by inner and outer corners 7 and 9, respectively, and a rear portion 13. Front edge 5 and rear portion 13 are held in spaced-apart arrangement by a pair of opposed side edges 15 that extend therebetween.

Blade 3 is preferably made by an injection mold process and the materials used are plastics, such as polystyrene, polyethylene, polybutadiene and the like, as well as alloys of plastics and elastomers such as neoprene, polybutylene, and terpolymers such as acrylonitrile-butadiene-styrene (ABS). The toughness is needed to allow the blade to retain its overall shape during the powerful flutter kick by the swimmer that forces plane x—x of the blade directly against the surrounding water.

Figure 4:
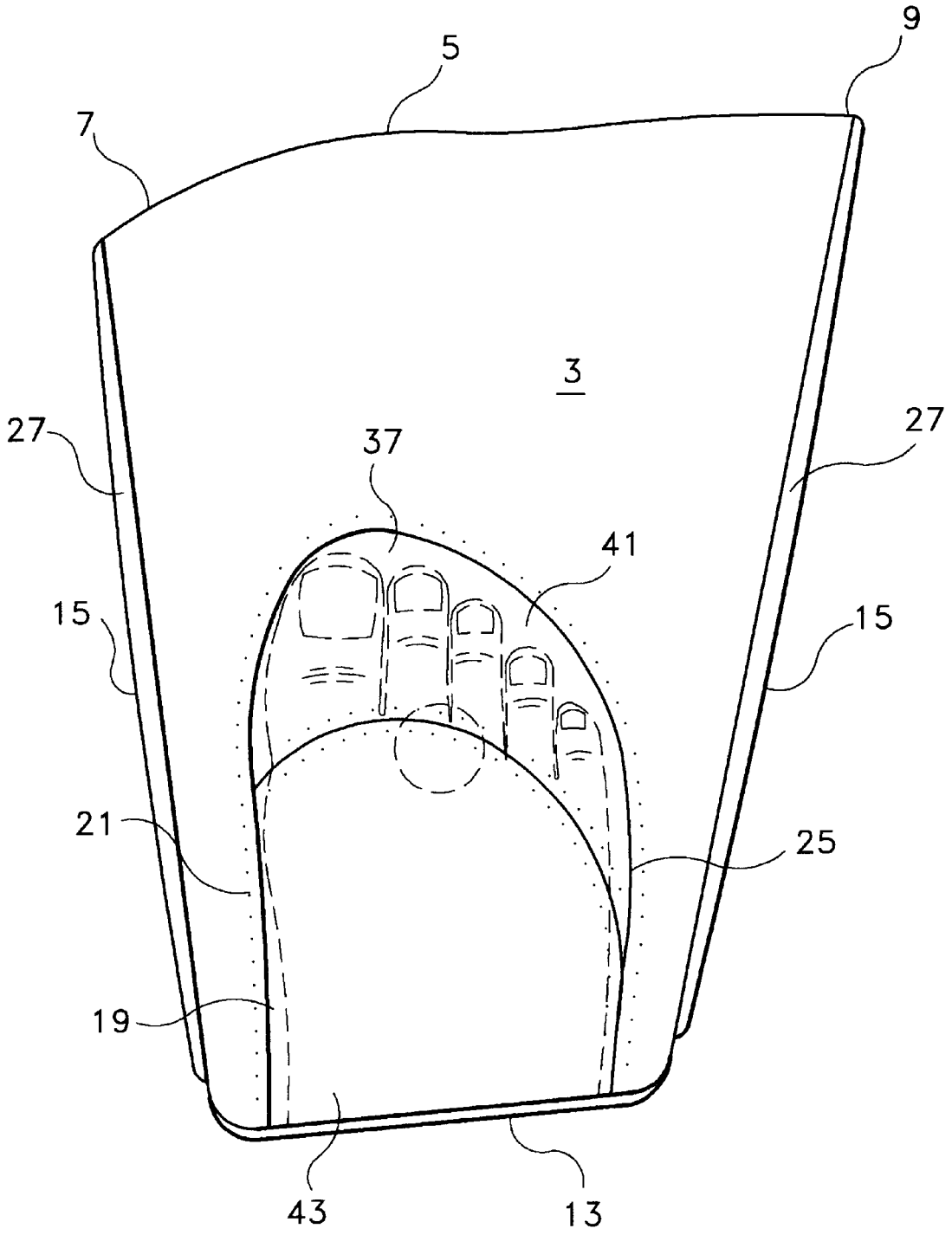
FIG. 4 is a top plan view of the preferred embodiment of this invention showing the position of the front part of the foot of the swimmer.

In this preferred embodiment, rear portion 13 of blade 3 has formed therein the bottom portion 17 of a foot pocket 19 that is arranged about a second planar surface y—y that is at an angle " " to plane x—x as shown in FIG. 3. Foot pocket 19 is used to receive the inserted front portion of the swimmer's foot as shown in FIG. 4.

Foot pocket 19 is specifically outlined and designed for each foot so that one must use a pair of swim fins where one is specifically designed for the right foot and the other fin is designed for the left foot. As shown in FIGS. 1 and 4, one side 21 of pocket 19 borders the inside of the swimmers foot adjacent the big toe while the other side 25 of pocket 19 is spaced-apart from side 21 and borders the outside of the foot adjacent the little toe.

Significant in this invention is the fact that second planar surface y—y is inclined to the outside (of the foot) to first planar surface x—x to compensate for the natural pronation of the foot of the swimmer. This pronation, without compensation, will cause the swimmer to rotate blade 5 to the outside of the swimmer's foot and reduce the profile of the blade in the direction of forward motion of the swimmer. Reducing the profile means that the blade does not contact as much water as would occur if the blade would be directly perpendicular to the direction of travel of the swimmer and thus be much less efficient in propelling the swimmer. As shown in FIG. 3, this inclination of second planar surface y—y to first planar surface x—x is on the order of 5° to 15°.

Another aspect of this invention is the fact that this inventive design permits the swimmer to walk on dry land wearing the fins shown in the drawings with a substantial reduced chance of tripping or falling over blade 5. This is accomplished by providing inner corner 7 of blade 5 with a "round-off" as shown in FIGS. 1, 2 and 4. The term "round-off" is used herein by the inventor to signify the rounding off of inner corner 7 of blade 5 in contrast to the outline of outer corner 9 that is shown to be a sharp corner. With the "round-off" at inner corner 7, the swimmer may step forward and simultaneously lift his foot and corner 7 will not contact the ground during this step as often happens with other fins of other designs.

Figure 5:
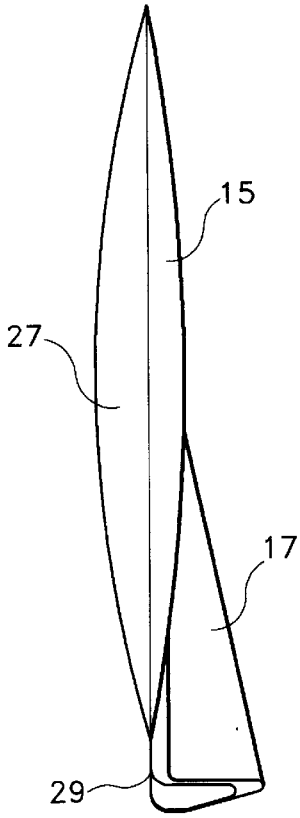
FIG. 5 is a side view of the preferred embodiment of this invention.

Another unique aspect of this invention is shown in FIGS. 1 and 5 where side edges 15 of blade 3 form side ribs 27 that extend above and below planar surface x—x and, simultaneously, diverge outward from foot pocket 19 to their respective blade corners 7 and 9. Ribs 27 perform a number of functions. First, they extend above and below planar surface x—x thus acting as rudders to help the swimmer direct his or her direction of travel. Secondly, they diverge outward from foot pocket 19 to the respective corners of blade 5 thereby providing a rather long rudder that does not have to be very tall in order to be effective at directional control. Thirdly, because of their rise above and below planar surface x—x, they reinforce and strengthen blade 5 and help to prevent unwanted distortion during the powerful flutter kicks. To make them as efficient as possible, as shown in FIG. 5, ribs 27 rise midway between their rear distal end 29 and their front distal end (corners 7 and 9) to a high point and veer downward from this midpoint to their respective ends.

As shown in FIGS. 1, 2 and 4, it is preferred that an aperture 31 be formed in bottom portion 17 of foot pocket 19 to allow drainage of water from foot pocket 19. Any number of apertures may be formed therein, however, at least one aperture is needed for best results.

While the swim fins of this invention may be made of tough yet flexible material, foot comfort is important to long term use of the fins. As shown in FIG. 3, a soft liner 33 is placed over bottom portion 17 of foot pocket 19 to provide this comfort. Liner 33 is preferably glued in place over pocket 19 or it may be sewn about the outer edge as shown in FIGS. 2 and 4 as dotted lines about foot pocket 19.

Figure 6:
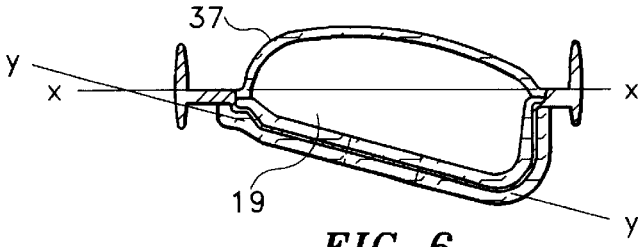
FIG. 6 is a similar view as in FIG. 3 with the foot pocket completely constructed.

To complete the entire foot pocket, a fabric liner 37 is placed over foot pocket bottom portion 19 as shown in FIG. 6 and glued, sewn or otherwise anchored about the outside edge 39. The combination of fabric liner 37 and foot pocket bottom portion 19 completes the entire pocket and allows the foot of the swimmer some comfort therein during walking on dry land and during use under water. It should be noted that, in this invention, fabric liner 37 rises above first planar surface x—x to improve control of the fins in the water. To further improve the comfort to the swimmer, this design is modified to that shown in FIG. 4 where fabric liner 37 is divided into a first band 41 of non-stretchable fabric that is placed above where the toes of the swimmer will reside in the forward part of foot pocket 19 and a second band 43 of stretchable fabric covering another, rearward part of foot pocket bottom portion 19 above where the instep of the wearer will be located for contact with the top of the foot of the wearer, to provide a snug fit of the swim fin to the foot of the wearer without cramping the toes of the wearer. As shown in FIG. 4, first band 41 and second band 43 are sewn together along their respective mating marginal edges to add strength to the fabrics.

As shown in FIG. 2, invention 1 contemplates an open heel portion and a heel strap 45 extending thereacross. More particularly, heel strap 45 is shown to comprise a pair of half heel straps 49, each having one distal end 51 attached to the outside of foot pocket bottom portion 17 and the other distal end 53 arranged to come into overlapping contact with the other half strap of the pair. At the interfacial end of each strap 49 there is a means 55 to connect the straps together in temporary connection.

Figure 8:
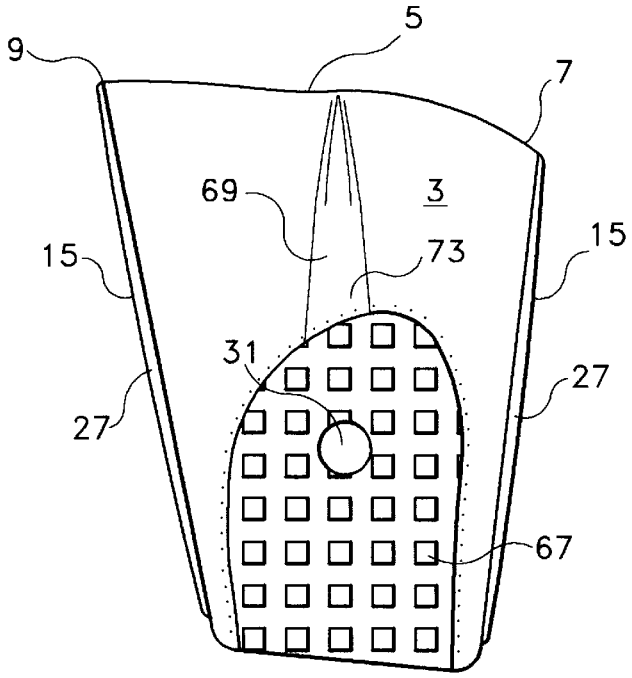
FIG. 8 is a bottom plan view of the preferred embodiment of the invention showing the tread overlaid the bottom portion of the foot pocket.

While said means 55 may take the form of laces or snaps or clasps and the like, it is preferred that it take the shape of a strip or patch of flexible material 57, fastened to half heel strap 49, such as by sewing along the edges thereof, and containing a large plurality of loop elements 61 thereof in conjunction with a similar strip 63 sewn to the other half heel strap 49 and containing an upwardly facing large plurality of hook elements 65. Loop element 61 and hook elements 65 are resilient and deformable and when pressed together become removeably entangled securing strips 57 and 63 together in joined abutment. Strips 57 and 63 can be released from entangled engagement by positively pulling hook elements 65 away from loop elements 61 or vice versa. The loop and hook fabric elements 61 and 65 are available under the trademark "Velcro", more specific details of which may be had from U.S. Pat. No. 2,717,437 titled VELVET TYPE FABRIC AND METHOD OF PRODUCING SAME issued Sep. 13, 1955 to George de Mestral and U.S. Pat. No. 3,114,951 titled DEVICE FOR JOINING TWO FLEXIBLE ELEMENTS issued Dec. 24, 1963 to George de Mestral. The material is presently sold under the trademark "Velcro®", a product of American Velcro, Inc. To improve the traction of these swim fins on dry land, such as when the swimmer is walking to or from the water, a tread 67 is applied only over the outer or underneath surface of bottom portion 17 of foot pocket 19 as shown in FIG. 8. The foam should not have the capacity to absorb water because it will become wet during use and be slow to dry out thus providing a focal point for mildew or other microbe to grow and exude an undesirable odor. The foam also should not be of the size or shape to interfere with the flow of water past the fins during use under water.

The preferred tread is that made from non-reticulated foams of plastic, flexible elastomers, and flexible plastic-flexible elastomeric blends. Such closed-cell foam as polyethylene and polybutylene serve this function well. Tread 67 may be glued over pocket bottom portion 17 or sewn in dotted outline as shown in FIG. 8 or be a combination of the two.

Figure 9:
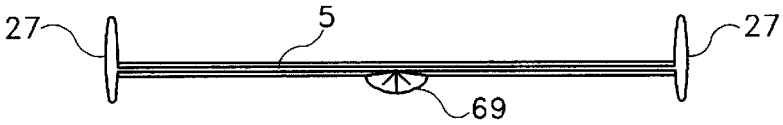
FIG. 9 is a front plan view of the preferred embodiment of this invention show:ng the thinning of the blade as it progresses toward the front of the blade.

To further provide stiffening to blade 3, an elongated rib 69 is formed, such as by molding, in the undersurface of blade 3 as shown in FIGS. 8 and 9. It is generally not placed on the top surface of blade 3 because it may interfere with the placement of fabric over bottom portion 17 of foot pocket 19. For maximum strength and minimum use of material, rib 69 is shown in FIG. 8 as having a maximum width at its rearward end 73 and a minimum width at its forward end.

Figure 10:
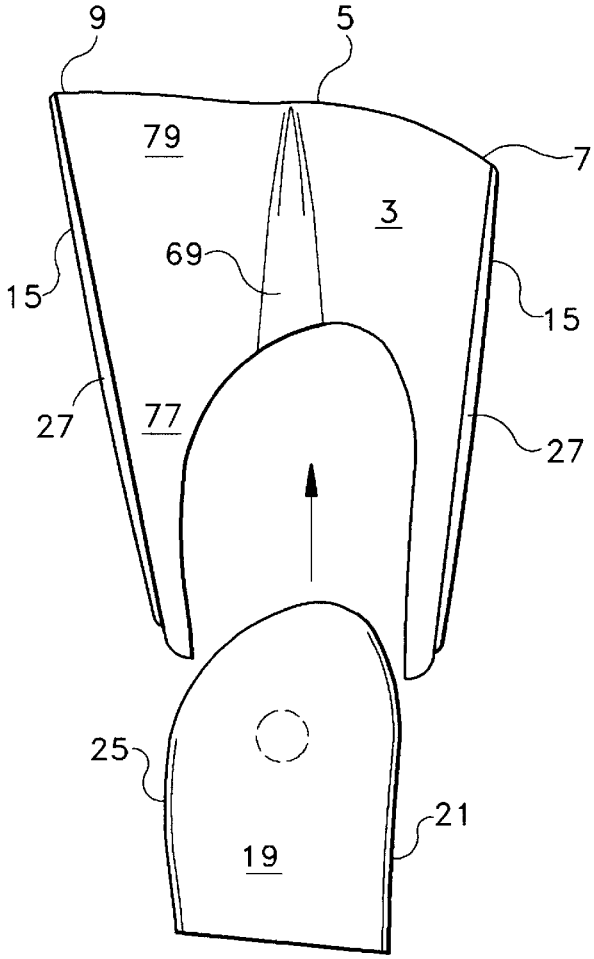
FIG. 10 is a top plan view of the portion of the invention that is molded in a first step and the later addition of the foot pocket by insert molding.

To still further provide stiffening to blade 3, it is preferred that blade 3 have increased thickness where the force against the blade is maximum. This would be in the area adjacent foot pocket 19. Accordingly, as shown in FIGS. 9 and 10, blade 3 is at its maximum thickness 77 near foot pocket 19 and tapering to its minimum thickness 79 at elongated front blade edge 5.

This invention also contemplates a method of making the swim fins that is unique among other methods thereof. The inventive method comprises the steps of molding in a first step from a relatively rigid material blade 3 having a first planar surface x—x and defined by an elongated front edge 5 terminated by inner and outer corners 7 and 9 and rear portion 13, said front edge and rear portion held in spaced-apart arrangement by a pair of opposed side edges 15 extending therebetween, the rear portion of blade 5 to have formed therein bottom portion 17 of foot pocket 19 arranged about second planar surface y—y for partial insertion therein of the foot of the wearer and including open heel portion 19, wherein bottom portion 17 of foot pocket 19 is specifically outlined for each foot, including one slightly longer side 21 thereof bordering the inside of the foot and another slightly shorter side 39, spaced-apart therefrom, bordering the outside of the foot and, wherein said second planar surface y—y of pocket 19 is inclined to the outside of said first planar surface of blade 3 to compensate for the natural pronation of the foot in the fin when the fins are used in undulating movement so as to improve the efficiency of said fins during use; attaching as a second step first band 41 of non-stretchable fabric over one part of bottom portion 17 of said foot pocket, above where the toes of the wearer will be located for contact with the toes of the wearer, and second band 43 of stretchable fabric covering another part of said bottom portion of said foot pocket, above where the instep of the wearer will be located for contact with the top of the foot of the wearer, to provide a snug fit of the swim fin to the foot of the wearer without cramping the toes of the wearer; and, adding heel strap 45 to said bottom portion of said foot pocket to retain the wearer's foot in said pocket during use.

In a modification of the aforesaid process, the foot pocket is not molded into the swim fin at the beginning step but is added later under what is commonly called "insert" molding. This is shown in FIG. 10 and is as follows: The method involves a first step that is modified in the first step to molding in a first step from a relatively rigid material a blade having a first planar surface and defined by an elongated front edge terminated by inner and outer corners and a rear portion, said front edge and rear portion held in spaced-apart arrangement by a pair of opposed side edges extending therebetween and adding, as a second step, a separate foot pocket arranged about a second planar surface to said blade for partial insertion therein of the foot of the wearer, said foot pocket including an open heel portion, wherein said foot pocket is specifically outlined for each foot, including one slightly longer side thereof bordering the inside of the foot and another slightly shorter side, spaced-apart therefrom, bordering the outside of the foot and, wherein said second planar surface of said pocket is inclined to the outside of said first planar surface of said blade to compensate for the natural pronation of the foot in the fin when the fins are used in undulating movement so as to improve the efficiency of said fins during use.

Figure 11:
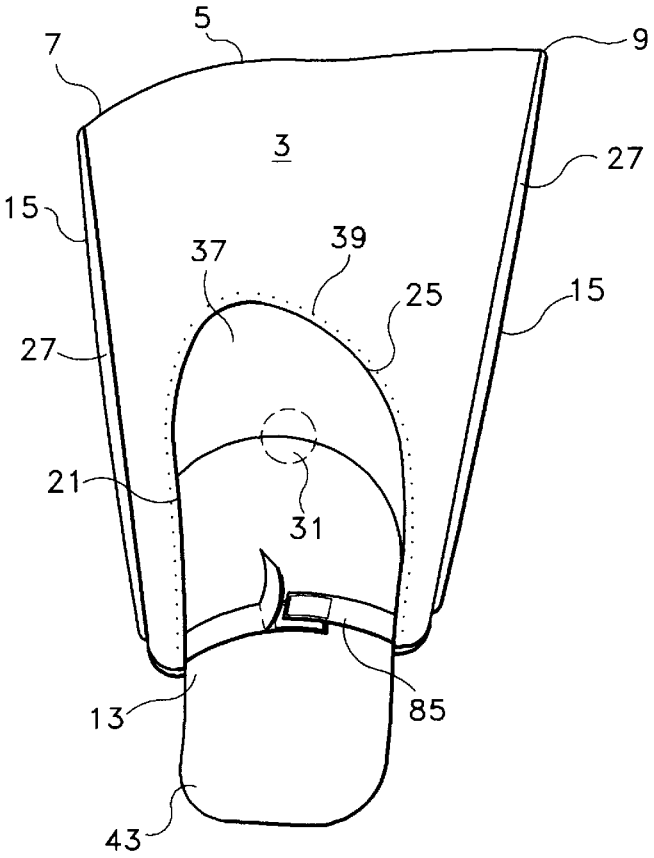
FIG. 11 is a view similar to that shown in FIG. 7 showing the addition of strips of removeably attachable Velcro strips at the rear portion of the blade to go over the swimmer's foot to enhance the attachment between the swim fin and the swimmer's foot; and, FIG. 12 is a view similar to that shown in FIG. 11 showing the strip of flexible material folded up over the attached Velcro strips over the swimmer's foot to hide the strips and protect them from damage during use of the fins.
Figure 12:
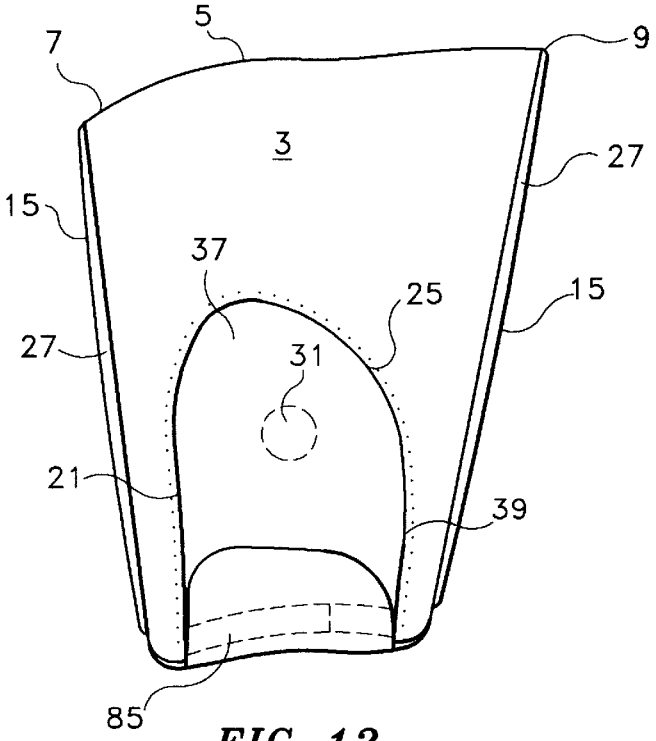

In a still further modification of the novel swim fin of this invention, FIG. 11 shows the addition of two strips 85 of releasable attachable material, such as the aforesaid Velcro, each one of said strips 85 extending across rear portion 13 of 3 blade from each side edge 15 thereof toward each other to overlap at about the middle of rear portion 13. The free ends of strips 85 are of a length to meet and interconnect together in overlap fashion over the top of the instep of the swimmer's foot, to provide further support to hold swim fin 1 on the swimmer's foot. In this embodiment, it is desirable to extend second band 43 of stretchable material rearward of blade rear portion 13 a distance such as to allow it to be folded upward and forward over strips 85 as shown in FIG. 12. In this fashion, the interconnection of strips 85 will be protected from the elements (coral, weeds, etc.) found in the underwater environment without interfering with adjustment of the strips whenever desired.

As a further embodiment, two strips 85 may be increased to three strips so that the two outside strips of Velcro face inward toward the center strip and the center strip carries releasable connection loops or hooks on both sides thereof so that all three strips can meet in overlapping engagement with a further layer of interconnected material. This is already a known practice in the prior art.

While the invention has been described with reference to a particular embodiment thereof, those skilled in the art will be able to make various modifications to the described embodiment of the invention without departing from the true spirit and scope thereof. It is intended that all combinations of members and steps which perform substantially the same function in substantially the way to achieve substantially the same result are within the scope of this invention.

What is claimed is:

1. A pair of swim fins, each fin comprising:

a) a blade having a first planar surface and defined by an elongated front edge terminated by inner and outer corners and a rear portion, said front edge and rear portion held in spaced-apart arrangement by a pair of opposed side edges extending therebetween;

b) the rear portion of said blade having formed therein the bottom portion of a foot pocket arranged about a second planar surface for partial insertion therein of the foot of the wearer and including an open heel portion and heel strap to retain the foot in said pocket;

c) wherein said bottom portion of said foot pocket is specifically outlined for each foot, including one slightly longer side thereof bordering the inside of the foot and another slightly shorter side, spaced-apart therefrom, bordering the outside of the foot; and, d) wherein said second planar surface of said pocket is inclined to the outside of said first planar surface of said blade to compensate for the natural pronation of the foot in the fin when the fins are used in undulating movement so as to improve the efficiency of said fins during use.

2. The swim fins of claim 1 wherein said elongated front edge of said blade includes a round-off at said inner corner thereof to facilitate walking on a surface out of water wearing said fins.

3. The swim fins of claim 1 wherein said opposed side edges of said blade diverge outward from adjacent said sides of said pocket to said inner and outer corners of said front blade edge.

4. The swim fins of claim 1 wherein said opposed side edges of said blade include side ribs extending above and below said first planar surface.

5. The swim fins of claim 4 wherein said side ribs vary in height from said pocket to said inner and outer corners of said front blade edge and reach a maximum height half-way from said pocket to said corners.

6. The swim fins of claim 1 further including an aperture formed in said bottom portion of said foot pocket for draining water therefrom.

7. The swim fins of claim 1 wherein said blade and bottom portion of said foot pocket are constructed of tough yet slightly yielding material and further including a soft liner over and against said bottom portion of said foot pocket to provide enhanced comfort to the wearer.

8. The swim fins of claim 1 further including a fabric top foot portion mounted over and above said bottom portion of said foot pocket to complete the pocket and enclose the forward part of the foot therein during use of the fin.

9. The swim fins of claim 1 wherein said blade and bottom portion of said foot pocket are constructed of tough yet slightly yielding material and including a soft liner over and against said bottom portion of said foot pocket to provide enhanced comfort to the wearer and further including a fabric top foot portion mounted over said soft liner to completely enclose the forward part of the foot during use of the fin.

10. The swim fins of claim 1 wherein said heel strap is attached to said blade at said rear portion thereof adjacent said blade side edges.

11. The swim fins of claim 1 further including a fabric top foot portion mounted over and above said bottom portion of said foot pocket to complete the pocket and enclose the forward pan of the foot therein during use of the fin wherein said fabric top rises above said first planar surface.

12. The swim fins of claim 1 further including a separate tread attached to the underside of said bottom portion of said foot pocket for providing traction during walking with said fin on the wearer's foot.

13. The swim fins of claim 12 wherein said separate tread is selected from the group consisting of flexible foams of plastic, flexible elastomeric, and flexible plastic-flexible elastomeric blends.

14. The swim fins of claim 1 further including an elongated rib formed in said blade midway between said side edges to provide stiffening to said blade during use.

15. The swim fins of claim 1 wherein said blade is further defined by an inner thick portion near said bottom portion of said foot pocket that tapers to a thinner portion at said elongated front edge.

16. The swim fins of claim 1 further including a first band of non-stretchable fabric attached over one part of said bottom portion of said foot pocket, above where the toes of the wearer will be located for contact with the toes of the wearer, and a second band of stretchable fabric covering another part of said bottom portion of said foot pocket, above where the instep of the wearer will be located for contact with the top of the foot of the wearer, to provide a snug fit of the swim fin to the foot of the wearer without cramping the toes of the wearer.

17. A pair of swim fins, each fin comprising:

a) a blade having a first planar surface and defined by an elongated front edge terminated by inner and outer comers and a rear portion, said front edge and rear portion held in spaced-apart arrangement by a pair of opposed side edges extending therebetween;

b) the rear portion of said blade having formed therein the bottom portion of a foot pocket arranged about a second planar surface for partial insertion therein of the foot of the wearer and including an open heel portion and heel strap to retain the foot in said pocket;

c) said elongated front edge including a round-off at said inner corner thereof to facilitate walking on a surface out of water wearing said fins;

d) a separate tread attached to the underside of said bottom portion of said foot pocket for providing traction during walking with said fin on the wearer's foot;

e) wherein said bottom portion of said foot pocket is specifically outlined for each foot, including one slightly longer side thereof bordering the inside of the foot and another slightly shorter side, spaced-apart therefrom, bordering the outside of the foot; and, f) wherein said second planar surface of said pocket is inclined to the outside of said first planar surface of said blade to compensate for the natural pronation of the foot in the fin when the fins are used in undulating movement so as to improve the efficiency of said fins during use.

18. The swim fins of claim 17 further including a first band of non-stretchable fabric attached over one part of said bottom portion of said foot pocket, above where the toes of the wearer will be located for contact with the toes of the wearer, and a second band of stretchable fabric covering another part of said bottom portion of said foot pocket and to said first band, above where the instep of the wearer will be located for contact with the top of the foot of the wearer, to provide a snug fit of the swim fin to the foot of the wearer without cramping the toes of the wearer.

19. The method of making a swim fin comprising:

a) molding in a first step from a relatively rigid material a blade having a first planar surface and defined by an elongated front edge terminated by inner and outer corners and a rear portion, said front edge and rear portion held in spaced-apart arrangement by a pair of opposed side edges extending therebetween, the rear portion of said blade to have formed therein the bottom portion of a foot pocket arranged about a second planar surface for partial insertion therein of the foot of the wearer and including an open heel portion, wherein said bottom portion of said foot pocket is specifically out-lined for each foot, including one slightly longer side thereof bordering the inside of the foot and another slightly shorter side, spaced-apart therefrom, bordering the outside of the foot and, wherein said second planar surface of said pocket is inclined to the outside of said first planar surface of said blade to compensate for the natural pronation of the foot in the fin when the fins are used in undulating movement so as to improve the efficiency of said fins during use;

b) attaching as a second step a first band of non-stretchable fabric attached over one part of said bottom portion of said foot pocket, above where the toes of the wearer will be located for contact with the toes of the wearer, and a second band of stretchable fabric covering another part of said bottom portion of said foot pocket, above where the instep of the wearer will be located for contact with the top of the foot of the wearer, to provide a snug fit of the swim fin to the foot of the wearer without cramping the toes of the wearer; and, c) adding a heel strap to said bottom portion of said foot pocket to retain the wearer's foot in said pocket during use.

20. The method of claim 19 wherein said first step of molding from a relatively rigid material a blade having a first planar surface and defined by an elongated front edge terminated by inner and outer corners and a rear portion, said front edge and rear portion held in spaced-apart arrangement by a pair of opposed side edges extending therebetween, the rear portion of said blade to have formed therein the bottom portion of a foot pocket arranged about a second planar surface for partial insertion therein of the foot of the wearer and including an open heel portion, wherein said bottom portion of said foot pocket is specifically outlined for each foot, including one slightly longer side thereof bordering the inside of the foot and another slightly shorter side, spaced-apart therefrom, bordering the outside of the foot and, wherein said second planar surface of said pocket is inclined to the outside of said first planar surface of said blade to compensate for the natural pronation of the foot in the fin when the fins are used in undulating movement so as to improve the efficiency of said fins during use, is modified to comprise the separate steps of:

a) molding in a first step from a relatively rigid material a blade having a first planar surface and defined by an elongated front edge terminated by inner and outer corners and a rear portion, said front edge and rear portion held in spaced-apart arrangement by a pair of opposed side edges extending therebetween;

b) adding, as a second step, a foot pocket arranged about a second planar surface to said blade for partial insertion therein of the foot of the wearer, said foot pocket including an open heel portion, wherein said foot pocket is specifically outlined for each foot, including one slightly longer side thereof bordering the inside of the foot and another slightly shorter side, spaced-apart therefrom, bordering the outside of the foot and, wherein said second planar surface of said pocket is inclined to the outside of said first planar surface of said blade to compensate for the natural pronation of the foot in the fin when the fins are used in undulating movement so as to improve the efficiency of said fins during use.

21. A pair of swim fins, each fin comprising:

a) a blade having a first planar surface and defined by an elongated front edge terminated by inner and outer corners and a rear portion, said front edge and rear portion held in spaced-apart arrangement by a pair of opposed side edges extending therebetween;

b) the rear portion of said blade having formed therein the bottom portion of a foot pocket arranged about a second planar surface for partial insertion therein of the foot of the wearer and including an open heel portion and heel strap to retain the foot in said pocket;

c) said elongated front edge including a round-off at said inner corner thereof to facilitate walking on a surface out of water wearing said fins;

d) a separate tread attached to the underside of said bottom portion of said foot pocket for providing traction during walking with said fin on the wearer's foot;

e) wherein said bottom portion of said foot pocket is specifically outlined for each foot, including one slightly longer side thereof bordering the inside of the foot and another slightly shorter side, spaced-apart therefrom, bordering the outside of the foot;

f) wherein said second planar surface of said pocket is inclined to the outside of said first planar surface of said blade to compensate for the natural pronation of the foot in the fin when the fins are used in undulating movement so as to improve the efficiency of said fins during use;

g) a first band of non-stretchable fabric attached over one part of said bottom portion of said foot pocket, above where the toes of the wearer will be located for contact with the toes of the wearer;

h) a second band of stretchable fabric covering another part of said bottom portion of said foot pocket and to said first band, above where the instep of the wearer will be located for contact with the top of the foot of the wearer, to provide a snug fit of the swim fin to the foot of the wearer without cramping the toes of the wearer;

i) at least two strips of releaseably engagable material, each one of said strips extending across said rear portion of said blade from each said side edge thereof, toward each other and adapted to interconnect in overlap fashion over the top of the swimmers foot, to provide further support to hold said swim fin on the swimmer's foot; and, j) said second band of material being of sufficient length to allow folding of a portion thereof forward over said interconnected strips of releasably engageable material.

22. The swim fins of claim 21 further including an additional strip of releasably engageable material so that two said strips of releasably engageable material may be used to interconnect in overlap fashion with a third strip of said releasably engageable material to seal said third strip therebetween.

* * * * *